US005246154A

United States Patent [19]

Adams et al.

[11] Patent Number: 5,246,154

[45] Date of Patent: Sep. 21, 1993

[54] CARRIER FOR ARCHERY BOW AND OTHER EQUIPMENT

[76] Inventors: O. Clair Adams; Anita C. Adams, both of 401 Shepard Ridge Rd., Farmington, Utah 84025

[21] Appl. No.: 800,229

[22] Filed: Nov. 29, 1991

[51] Int. Cl.[5] ..... A45F 3/14

[52] U.S. Cl. ..... 224/257; 224/150; 224/250; 224/258; 224/913; 224/916

[58] Field of Search ..... 224/258, 149, 150, 202, 224/250, 257, 913, 916

[56] References Cited

U.S. PATENT DOCUMENTS

| | | | |
|---|---|---|---|
| 2,273,136 | 2/1942 | Orech et al. | 224/258 |
| 2,356,209 | 8/1944 | Brilhart | 224/258 |
| 3,211,351 | 10/1965 | Somple | 224/150 |
| 3,998,367 | 12/1976 | Harding | 224/916 X |
| 4,121,743 | 10/1978 | Burton | 224/916 X |
| 4,684,047 | 8/1987 | Burgwin | 224/253 |
| 4,768,689 | 9/1988 | Davis | 224/257 |
| 4,819,844 | 4/1989 | Niemelä | 224/150 |
| 4,903,875 | 2/1990 | Smart et al. | 224/258 |
| 5,038,987 | 8/1991 | Huddleston | 224/258 |
| 5,065,732 | 11/1991 | Smith | 224/258 X |

*Primary Examiner*—Allan N. Shoap
*Assistant Examiner*—Vanessa Caretto
*Attorney, Agent, or Firm*—Madson & Metcalf

[57] ABSTRACT

A carrying device for archery bow and other equipment. The device includes an adjustable shoulder strap and an attached shock cord large enough to diagonally encircle the user's body. A padded shoulder protector and pull tab-manufacturer's label are affixed to the strap. An attachment-release assembly including a block and an attachment cord is suspended from the shock cord.

9 Claims, 5 Drawing Sheets

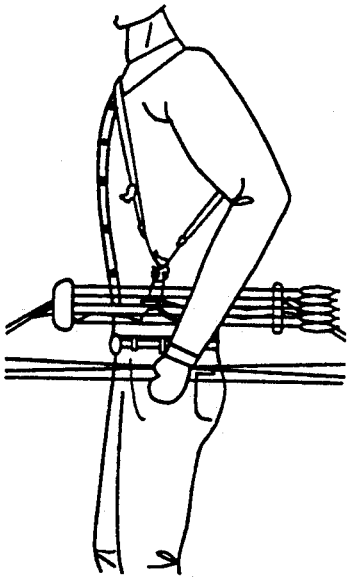
FIG. 2-A
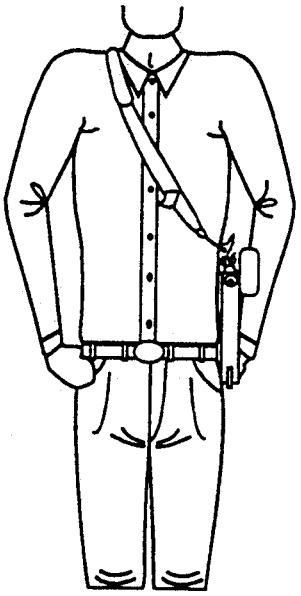
FIG. 2-B
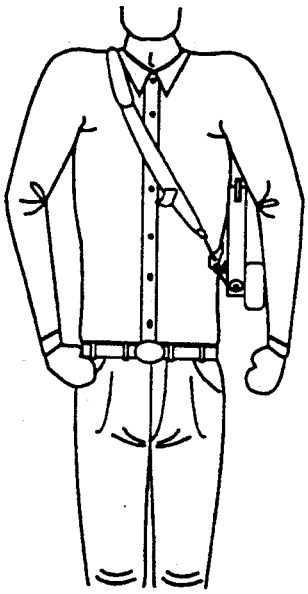
FIG. 2-C
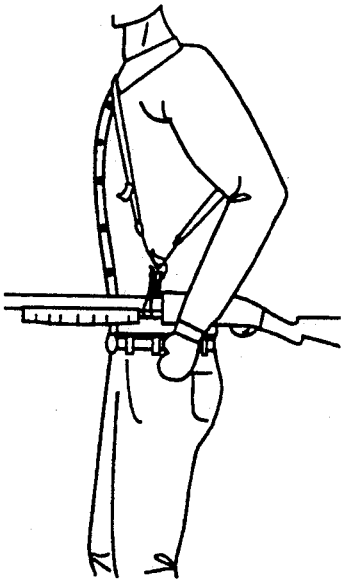
FIG. 2-D
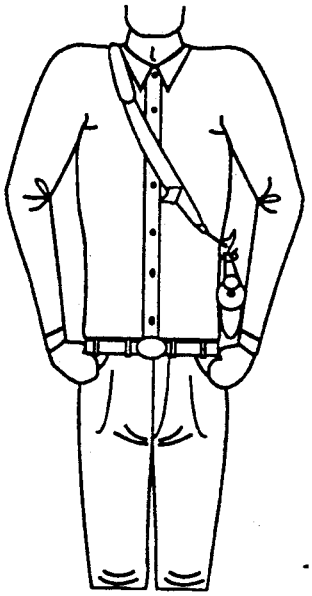
FIG. 2-E

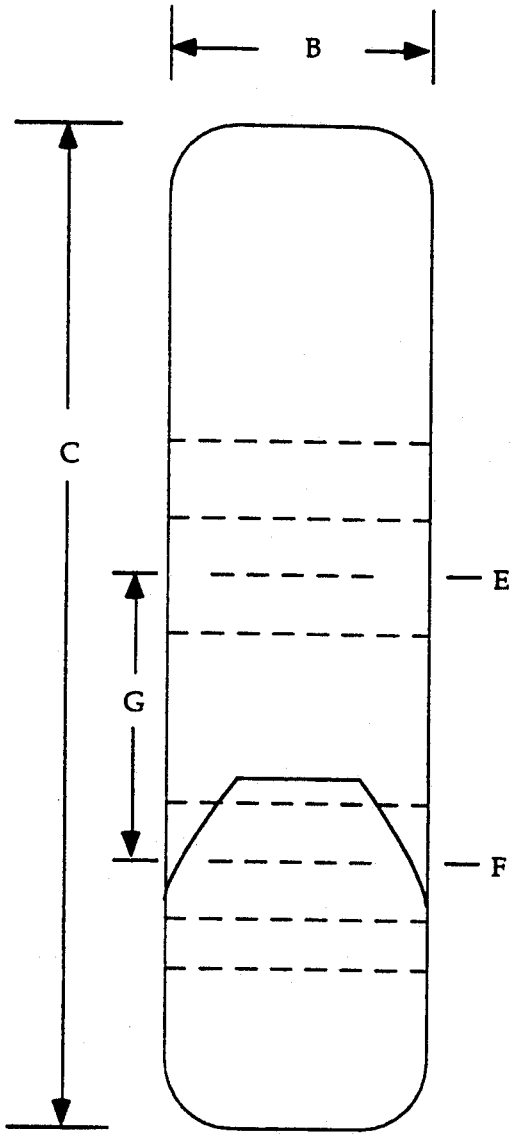
FIG. 3-A
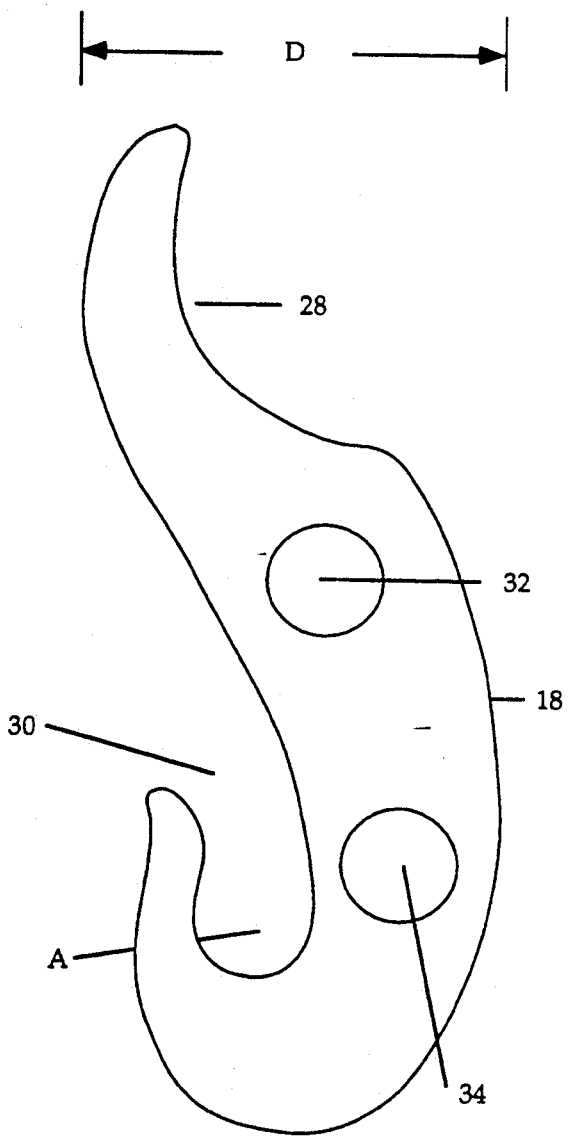
FIG. 3-B

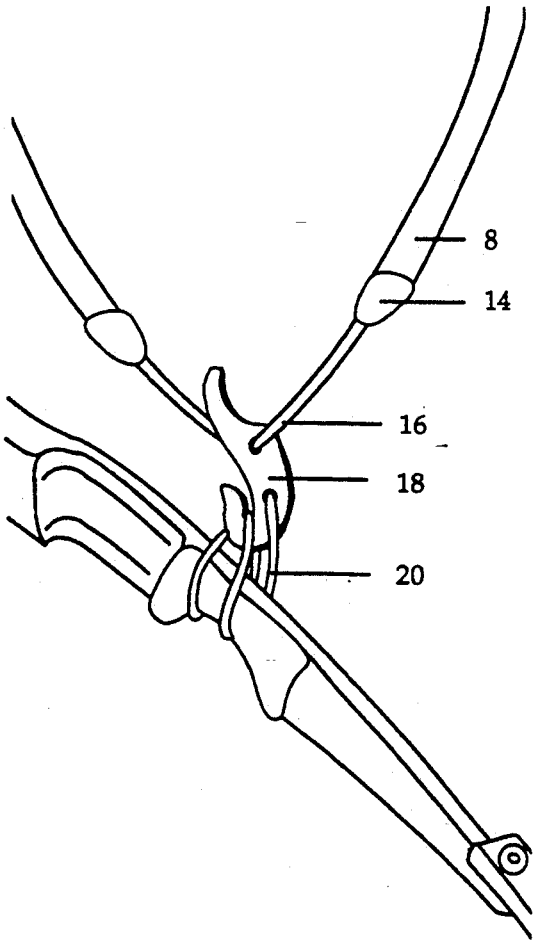
FIG. 4-A
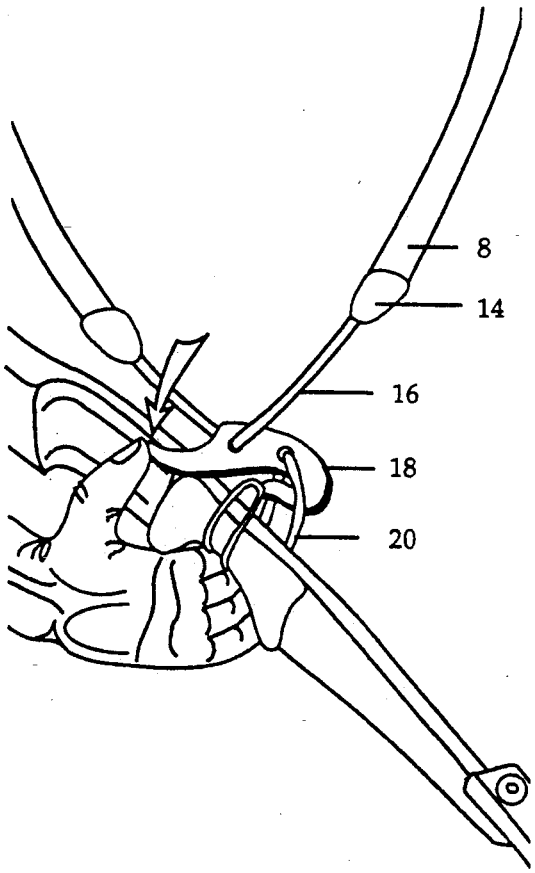
FIG. 4-B

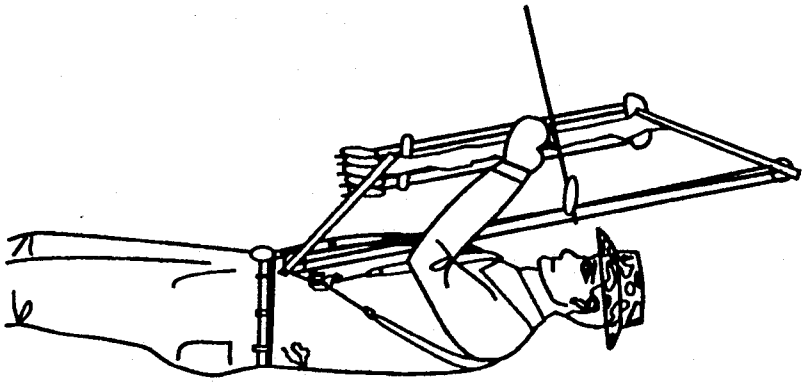
FIG. 5-A
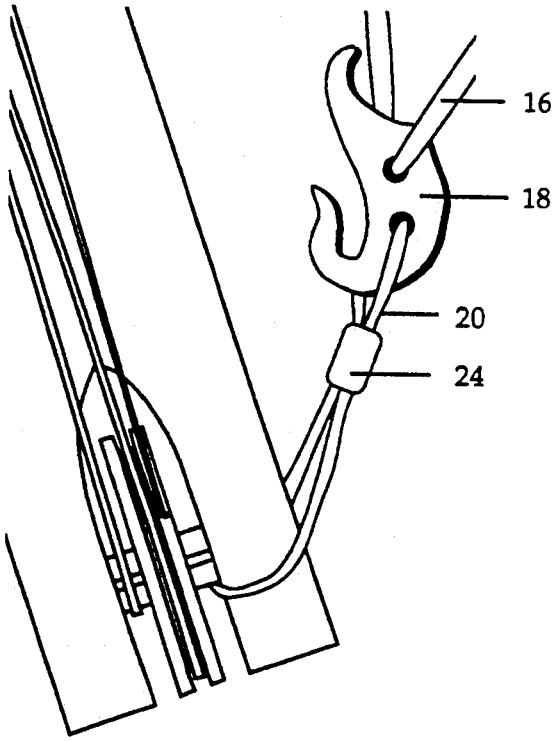
FIG. 5-B

CARRIER FOR ARCHERY BOW AND OTHER EQUIPMENT

BACKGROUND

1. Field of Invention

This invention relates to securely and comfortably carrying an archery bow, or certain other equipment. It allows convenient one-hand attachment and enables silent, instant, one-touch release by the user. While this patent application emphasizes the value of this invention as an archery bow carrier, it works equally well for many other items.

2. Description of Prior Art

The American Indian carried his bow over his shoulder, handle against his chest and string across his back. Many other archers have done likewise with straight-limb or recurve bows. Today, however, about 90 percent of the bows used are compounds. Cables, metal bars and bow quivers now prevent the archer from "slinging his bow over his back."

Archery has grown into a major sport and the physical weight of the bow and attached equipment has greatly increased. The market for a good dependable bow carrier now exists. Several carriers have been devised, but because of critical design and functional flaws, none have done well in the market place.

One prior art commercial bow carrier is marketed under the trade name Spare Arm. The Spare Arm carrier includes a 5.08 cm wide web belt doubled back and sewn onto itself to form a belt loop. The other end of the webbing is sewn over a metal bar about 1.5 cm×0.32 cm×15.24 cm. The enclosed bar is then bent to form a hook that hangs suspended from the users belt at his (her) side.

The Spare Arm carrier is in limited use because of several very important drawbacks:

1. While the Spare Arm carrier carries the bow by the handle at about hip level, the bow string rides horizontally three to four inches above one's knee. Movement of the leg by normal walking causes abrasion of the knocking point, serving, peep sight and string itself. An attached bow quiver magnifies this problem by torquing the string into the leg. The bow is carried too low for adequate protection.

2. When not in use the Spare Arm carrier remains on one's side and frequently hooks tree limbs and shrubs.

3. Probably the most damaging drawback is that the Spare Arm carrier hooks one's bow string and cables while preparing for a shot or walking with bow in hand.

U.S. Pat. No. 4,121,743 to G. A. Burton in 1977 worked much like the Spare Arm carrier. Because the device, while not in use, hooked one's bowstring and other objects, its use is very limited.

In 1974 a bow carrier was devised and patented by J. F. Harding (U.S. Pat. No. 3,998,367). The harness could not be used with a back pack. Inasmuch as the device carried the bow on the back of the user, an excessive amount of movement was required to retrieve the bow preparatory for a shot. This made the device hard to use for the field and target shooter and totally unsuitable for the bow hunter.

U.S. Pat. No. 4,754,904 was granted in 1986 to A. G. Fischer and E. P. Fitzgerald. Like the Harding carrier, it could not be used with a back pack or day pack and it was not readily accessible or detachable without excessive movement and noise. The device was complicated, expensive to build, heavy and awkward to use.

At least two patents were issued for bow carriers in 1988. The carrier disclosed in U.S. Pat. No. 4,768,689 hooked the string of one's bow while not in use. Associated metal parts created noise. Both factors rendered the device unacceptable for the bow hunter. The carrier disclosed in U.S. Pat. No. 4,760,944 required both hands and considerable movements for attachment and detachment. This inconvenience, movement factor and the noise associated with the Velcro release made the device unacceptable for the bow hunter.

All carriers patented to date suffer from one or more of the following disadvantages:

(a) They are inaccessible to the user for control of the bow in crowds of people or in dense vegetation.
(b) They require too much movement for detachment in hunting situations.
(c) Noise, unacceptable in hunting, is created by the carry and/or release mechanism.
(d) They cannot be used in conjunction with a back pack or day pack.
(e) They cannot be used while riding a horse, ATV or motorcycle.
(f) They do not offer a holding position which puts the bow in a ready-to-shoot location.
(g) They are not moveable on the user's body, therefore, the bowstring and other objects get tangled in them.
(h) They are complicated and expensive to manufacture and use.
(i) They offer inadequate comfort of the user and protection of the bow.
(j) They do not offer a one-handed attachment and an instant, silent one-touch release.

OBJECTS AND ADVANTAGES

The basic object of a bow carrier is to allow a person to comfortably and safely carry a bow. Convenient attachment and instant silent release are important functions critical to the bow hunter.

This invention accomplishes these requirements and also provides several additional objects and advantages as indicated below:

(a) to provide a carrier which can be manufactured inexpensively and sold at a low price;
(b) to provide a simple, strong, dependable, foolproof, long-life carrying device;
(c) to provide a carrier that allows convenient one-hand attachment of the bow requiring no visual contact;
(d) to provide a carrier that provides the bow a cushioned, protected ride;
(e) to provide a carrier which independently carries the bow without support (both hands are free to perform other tasks);
(f) to provide a carrier which allows maneuvering of the bow (while in the attached position) in crowds of people or in thickly vegetated areas;
(g) to provide a carrier which positions the bow and string assembly to prevent bumps and abrasion;
(h) to provide a carrier which allows positioning of the bow for standing or walking in unobstructed areas; a second position which further protects the bow in brushy areas and while riding a motorcycle, ATV or horse; and a third carrying position which orients the bow in a ready-to-shoot position;
(i) to provide a carrier which will work equally well while carrying a full quiver of arrows, either in a bow quiver, back quiver or side quiver, or while carrying a back pack, day pack or fanny pack;

(j) to provide a carrier that holds the bow in a readily accessible position where it can be retrieved and readied for a shot with a minimum of movement;

(k) to provide a carrier which will instantly and silently release the bow into the archer's bow hand with one touch of the bow-hand thumb; and (1) to provide a carrier which allows the archer to rest the lower limb of a compound bow (with arrow on string) while waiting for the precise time to draw the bow for a shot. This positions the sighting window of the bow in a vertical position in the archer's line of sight, therefore, little additional motion is required to detach, draw the bow and shoot the arrow.

Further objects and advantages are to allow the attachment-release mechanism to be rotated to one's back to prevent hooking the bow string or other objects while not in use. The comfortable, secure carry and easy release make this device valuable for carrying shotguns, rifles, camcorders, small duffel bags or suitcases or other objects requiring safe, protected carry and convenient release.

BRIEF DESCRIPTION OF THE DRAWINGS

FIGS. 2A to 2E show the position of the carrier on a person with a bow and shotgun attached.

FIGS. 3A and 3B are side, plan views illustrating detail of the block.

FIGS. 4A and 4B illustrate the function of the hook-release mechanism performed by the block and attachment cord.

FIGS. 5A and 5B illustrate use of the carrier as a holding device, showing the carrier holding a bow ready for an eminent shot.

DESCRIPTION

Figure 1:
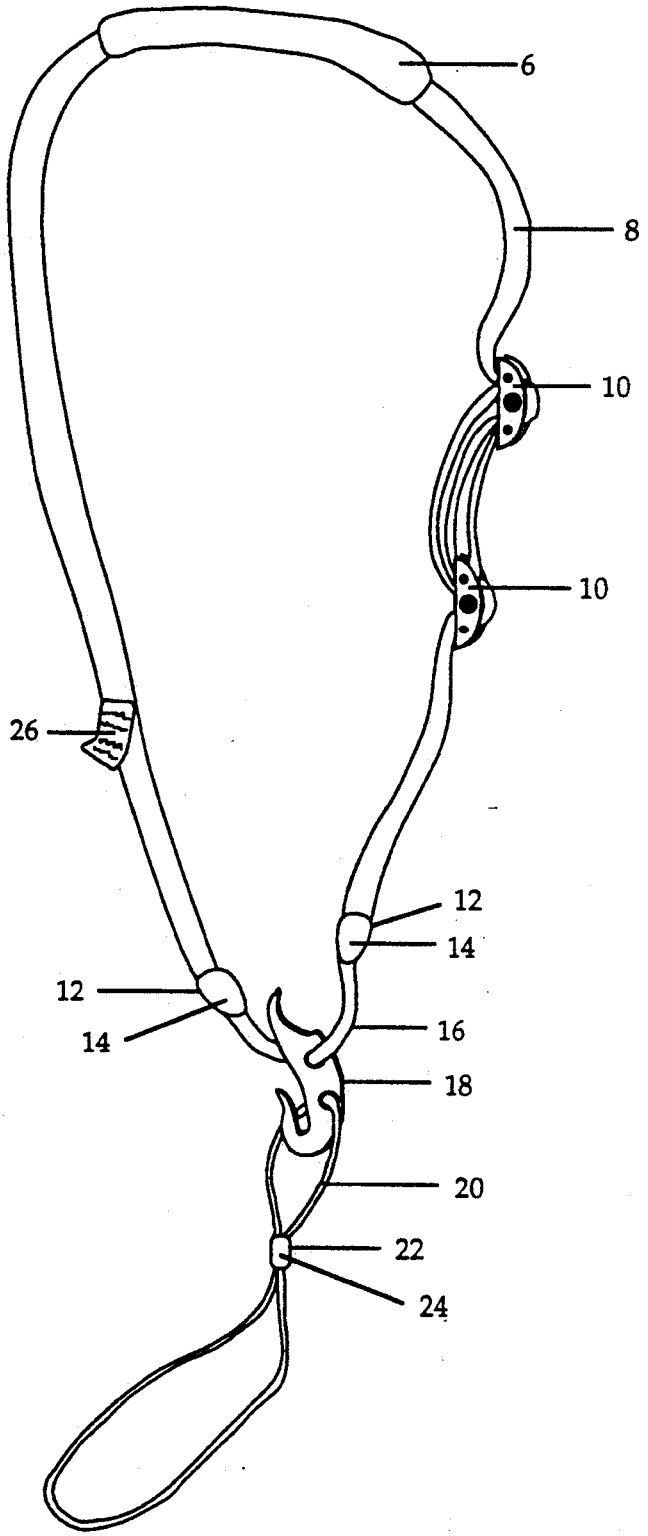
FIG. 1 is a perspective view of the Carrier Assembly.

The entire embodiment of the present invention is shown in FIG. 1. The padded shoulder protector 6 which will only appear on the deluxe model is typically made from a 11.4–6.3 cm×25 cm piece of polar fleece fabric sewn into a tube. The item is turned inside out and the strap 8 is inserted through it. The strap 8 is web-belt, typically 2.5 to 5.1 cm wide made of nylon or polypropylene. The strap 8 is about 122 cm long and is threaded through two 3-bar slides 10, making the length adjustable for different-size users.

Opposite ends of the strap s are attached to opposite ends of a 23 cm long piece of 0.63 cm diameter shock cord 16 by the use of Hog Nose clamps 12. Prior to making this attachment, the shock cord 16 has been threaded through the upper hole of the block 18 and a 2.5 cm section of heat shrink tube 14 is placed loosely over each end. After the strap 8 and shock cord 16 have been joined, the shrink tube 14 is implaced and shrunk to form a smooth covered attachment.

As Illustrated in FIG. 3B, the block IS includes a thumb tab, or release actuator means, 28, a hook 30, a shock cord hole 32 and an attachment cord hole 34. The interior of the hook 30 has a radius A of 0.28 cm. As viewed in FIG. 3A, the width B of the block 18 is 1.27 cm and the length C of the block 18 is 4.72 cm. The breadth D of the block 18 is 2.6 cm (FIG. 3B). The diameter E of the shock cord hole 32 and the diameter F of the attachment cord hole 34 are each 0.56 cm. The centers of the shock cord hole 32 and the attachment cord hole 34 are 1.10 cm apart, as illustrated at G in FIG. 3A.

A section of cord (nylon rope), herein named the attachment cord 20, about 46 cm long is then threaded through the lower hole in the block 18. The ends ar ® doubled back, overlapped and secured by a Hog Nose clamp 22 and covered by heat shrink tube 24. A piece of buckskin about 2.54 cm×5.08 cm is sewn to the strap 8 about 10 cm from the end opposite the 3-bar slides. This piece of buckskin is to be used as a pull tab 26 and will bear a stamped manufacturer's label.

FIGS. 2A, 2B, 2C, 2D and 2E illustrate the typical in-use position of the present invention while carrying an archery bow and a pump shotgun. Either position shown in FIGS. 2A, 2B or 2C and that shown in 2D and 2E afford comfortable, secure carry of a bow or shotgun and an instant silent detachment. The pull tab manufacturer's label 26 is a piece of buckskin that, when pulled downward, moves the block 18 around to the user's back where it cannot catch the bowstring or other objects while not in use.

FIG. 3 is a drawing of the block 18. This is the most important part of the present invention. The configuration and composition of the block 18 make it extremely simple, strong and fool proof. This part is presently made of strong Lexan or nylon and in the future will be injection molded of nylon or Delrin.

FIGS. 4A and 4B illustrate the configuration and function of the block 18 and attachment cord 20. The device is shown in the carry position (FIG. 4A) and the release position (FIG. 4B).

One of the highly beneficial uses of the present invention is detailed in FIGS. 5A and 5B. The attachment cord 20 cradles the lower limb of a bow, comfortably suspending the bow vertically in front of the user. When a shot is eminent, either while bow hunting or target shooting, the bow can be held in this "ready" position for an extended period of time without arm fatigue. This can be done while standing, walking, kneeling or sitting. The bow is held in a near-shooting position with the sight window directly in front of the archer's eye. In this position the archer's bow hand cradles the bow handle and with the very slightest upward movement, the attachment cord 20 falls free and the bow can be drawn and shot. This is extremely beneficial to the bow hunter and is also useful for the field and target archer. The butt of a shotgun or rifle can be cradled in the same manner, allowing very fast repositioning of the gun for a shot.

From the descriptions above, it is evident that this carrying device, primarily designed for an archery bow, has numerous advantages over all prior art:

(a) The archer has the choice of three carrying positions. Density of obstructions, personal activity (sitting, standing, walking or riding) and the degree of readiness desired dictates the position to be used.

(b) Both the bow and the user's shoulder are cushioned and protected.

(c) The attachment-release mechanism is very strong, simple to use and will last the user many, many years.

(d) The entire carry system is simple and easy to manufacture.

(e) The bow can be attached with one hand without visual contact.

(f) The bow can be released into the hand silently and instantly by one touch of the thumb without visual contact.

(g) The bow can be held in a "ready-to-shoot" position for long periods without fatiguing the user's arm.
(h) When not in use the carrier will not hook or entangle the bow string or nearby shrubbery.
(i) The carrier works equally well with or without a back pack, day pack, fanny pack or any type quiver.

The following discussion pertains to a right-handed shooter for simplicity of explanation. The device works equally well for a left-handed user.

To engage the carrier for use (FIGS. 2A-2E) the user extends his (her) left arm and head through the carrier assembly. The carrier thereby encircles the user's torso diagonally from right shoulder to left flank. Shoulder pad 6 (if present) fits over shoulder, adjusting slides 10 are in back and the block 18 hangs at the user's left side about four inches above the hip. Precisely the same assembly configuration is adjusted for use by a left-handed user by sliding the two adjusting slides 1? through the shoulder pad 6 to the opposite side of the strap 8.

The bow is commonly carried by the target shooter, field archer or bow hunter in a horizontal position with the handle in his (her) left hand. To attach the bow to this present invention, the user lifts the bow a few inches, extends the two middle fingers, bends the fingers hooking the lower loop of the attachment cord 20 and pulls the cord around the outside of the bow handle. Once the cord is securely hooked by the fingers, the other fingers release the weight of the bow to the attachment cord 20. The cord 20 is guided up over and released into the hook of the block 18 which is aligned in ready position by the Weight of the bow.

In its optimum position for an archery bow the carrier is adjusted so the bow string coincides with the user's palm as the arm hangs at his (her) side. The bow will hang with no additional support while walking or standing, freeing both hands for other tasks.

To release the bow the user cups his (her) fingers under the bow handle and presses down on the thumb tab of the block 18 (squeezing action between thumb and fingers). As the block is rotates, the attachment cord 20 falls free and the bow is released into the user's bow hand. At this point an Optional action can be taken. To guarantee that the hook of the block 18 does not catch the bow string, cables or anything nearby, the user pulls down on the pull tab 26 with his (her) right hand thus moving the block around to his (her) back. A reverse motion will retrieve it for use.

When walking through brush that are thick and high or if the user wishes to sit or ride a horse, ATV, etc., the bow can be rotated 180 degrees (while attached to the carrier as described above) into the alternate carry position illustrated by FIG. 2C. A bow with one of the more convenient bow quivers or with no bow quiver can be rotated laterally. In other words, the string is moved out and up under the users armpit. Bows with large quivers that extend a greater distance from the bow must be rotated 180 degrees longitudinally so that the bow remains between the user's body and the arrow-filled quiver. The bow is released into the user's bow hand by thumb pressure on the block 18 as described earlier.

While walking between field targets, waiting for a turn to shoot or when a shot at a game animal is eminent, the user may wish to support his (her) bow in a comfortable "ready to shoot" position. FIG. 5A illustrates this method of using the present invention. While most beneficial for compound bows, the method also works for recurve or long bows.

To attach, the attachment cord 20 is placed around on side of the lower limb of the compound bow (FIG. 5B) or the entire limb of a recurve or long bow. The weight of the bow is supported by the carrier assembly and the user's hand holds the bow in the vertical position. To release the assembly the bow weight is lifted, the attachment cord 20 falls free and the bow is ready to be shot.

Accordingly, this invention can transport an archery bow conveniently, safely and comfortably, can offer the user at least three separate ways to carry the bow depending on conditions or activities, can release the bow instantly and silently with one touch (a feature critical to the bow hunter), can be manufactured and sold inexpensively and is simple and strong enough to give many, many years of service to the user. Furthermore, the carrier has additional advantages in that:

it can be used with any type arrow quiver and for target or field shooting and bow hunting;
it can be used with a back pack, fanny pack or day pack;
it can be used while standing, walking, riding or sitting, even in a tree stand;
it is heat and weather resistant and waterproof; and
it provides a cushioned ride to the carried object and cushioned and padded protection to the user's shoulder.

Although the description above contains many specifications pertaining specifically to an archery bow, these should not be construed as limiting the scope of the invention but as merely providing a few examples of presently preferred embodiments of this invention. For example, the attachment cord can be altered in length and composition for use on any type rifle, shotgun, camcorder or other equipment.

Thus, the scope and value of this invention should be judged by the appended claims and their equivalents and not restricted by the very limited examples given herein.

I claim:

1. A weapon carrier for releasably supporting a weapon on a user, comprising:

a block configured with a hook;

an attachment cord having a first and a second end, the first end connected to the block, the attachment cord configured to extend about the weapon and engage the hook such that the weapon is supported by the carrier, the block further configured with release actuator means for causing the block to rotate upon the application of a force to the release actuator means and releasing the attachment cord from engagement with the hook to thereby release the weapon from the carrier; and a carrying cord attached to the block, the block attached to the cord such that the block may rotate upon the application of a force to the release actuator means.

2. A weapon carrier as defined in claim 1, wherein the second end of the attachment cord is configured with a loop such that engagement of the attachment cord with the hook may be accomplished by the user placing the loop on the hook.

3. A weapon carrier as defined in claim 1, wherein the block is configured with a first and second hole and the carrying cord extends through the first hole and the attachment cord extends through the second hole.

4. A weapon carrier as defined in claim 3, wherein the attachment cord is configured as a continuous loop.

5. A weapon carrier as defined in claim 1, wherein the block is further configured such that when the carrier is worn over the torso of the user, with the attachment cord, and such that actuation of the release actuator means causes the hook to move to a substantially horizontal position.

6. A weapon carrier as defined in claim 1, wherein the carrying cord is configured as a continuous loop thereby enabling the carrying cord to diagonally encircle the torso of the user.

7. A weapon carrier as defined in claim 6, further comprising a pull tab attached to the carrying cord, the pull tab configured such that the user may pull down on the pull tab to thereby rotate the carrying cord about the torso of the user.

8. A weapon carrier for releasably supporting a weapon on a user, comprising:

a block configured with a hook, a release actuator and a first and second hole;

an attachment cord configured as a continuous loop and extending through the second hole of the block, the attachment cord further configured to extend about the weapon and engage the hook by the user placing the loop over the hook such that the weapon is supported with the hook disposed in a substantially vertical position, the block further configured such that actuation of the release actuator causes the block to rotate, thereby causing the hook to move to a substantially horizontal position and releasing the attachment cord from engagement with the hook to thereby release the weapon from the carrier; and a carrying cord comprising a continuous loop and extending through the first hole of the block such that the carrying cord may diagonally encircle the torso of the user.

9. A weapon carrier as defined in claim 8, further comprising a pull tab attached to the carrying cord, the pull tab configured such that the user may pull down on the pull tab to thereby rotate the carrying cord about the torso of the user.

* * * * *